US008768152B2

(12) United States Patent
Fritschie et al.

(10) Patent No.: US 8,768,152 B2
(45) Date of Patent: Jul. 1, 2014

(54) GLASS-CERAMIC COOKTOP AND METHOD OF ASSEMBLING THE SAME

(71) Applicant: Whirlpool Corporation, Benton Harbor, MI (US)

(72) Inventors: Phillip K. Fritschie, Tulsa, OK (US); Richard K. Morrow, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/949,274

(22) Filed: Jul. 24, 2013

(65) Prior Publication Data

US 2013/0306618 A1 Nov. 21, 2013

Related U.S. Application Data

(63) Continuation of application No. 12/641,383, filed on Dec. 18, 2009, now Pat. No. 8,526,800.

(51) Int. Cl.
*F26B 19/00* (2006.01)

(52) U.S. Cl.
USPC ..... 392/418; 29/430; 29/436; 29/453

(58) Field of Classification Search
None
See application file for complete search history.

(56) References Cited

U.S. PATENT DOCUMENTS

| | | | | | |
|---|---|---|---|---|---|
| 2,500,309 | A | * | 3/1950 | Dunham | 211/184 |
| 2,671,254 | A | * | 3/1954 | Meyer | 24/291 |
| 2,865,063 | A | * | 12/1958 | Hartshorn | 52/773 |
| 2,911,608 | A | * | 11/1959 | Lee | 439/92 |
| 2,962,783 | A | * | 12/1960 | Elder | 52/713 |
| 3,082,665 | A | * | 3/1963 | Jackson | 52/393 |
| 3,978,554 | A | * | 9/1976 | Miller, Jr. | 52/712 |
| 4,319,733 | A | * | 3/1982 | Hanna et al. | 248/507 |
| D272,702 | S | * | 2/1984 | Kingsley, Jr. | D8/371 |
| 4,736,988 | A | * | 4/1988 | Chamberlin et al. | 301/37.31 |
| 4,900,899 | A | * | 2/1990 | Schreder et al. | 219/448.11 |
| 5,106,586 | A | * | 4/1992 | Muszak et al. | 422/560 |
| D357,227 | S | * | 4/1995 | Smithers | D13/179 |
| 5,410,128 | A | * | 4/1995 | Vermillion et al. | 219/454.12 |
| 5,466,970 | A | * | 11/1995 | Smithers | 257/712 |
| 5,549,098 | A | * | 8/1996 | Bales et al. | 126/211 |
| 5,859,410 | A | * | 1/1999 | White et al. | 219/452.11 |
| 5,928,543 | A | * | 7/1999 | Davis et al. | 219/451.1 |
| 6,508,300 | B1 | * | 1/2003 | Hegde | 165/80.3 |
| 7,009,151 | B2 | * | 3/2006 | Lee | 219/460.1 |

* cited by examiner

*Primary Examiner* — Thor Campbell

(57) ABSTRACT

A cooking appliance includes a glass cooktop panel and a cooktop frame. A radiant heating element is positioned between the cooktop frame and the glass cooktop panel. The heating element has an upper surface biased toward a lower surface of the glass cooktop panel. A screwless spring clip is coupled to both the heating element and the cooktop frame so as to secure the heating element to the cooktop frame.

20 Claims, 4 Drawing Sheets

GLASS-CERAMIC COOKTOP AND METHOD OF ASSEMBLING THE SAME

CROSS REFERENCE TO RELATED APPLICATION

This application is a continuation of patent application Ser. No. 12/641,383 filed Dec. 18, 2009, which is incorporated by reference in its entirety here.

TECHNICAL FIELD

The present disclosure relates generally to cooking appliances, and more particularly to glass-ceramic cooktop appliances.

BACKGROUND

A cooktop is a domestic appliance used to cook meals and other foodstuffs. One type of cooktop is a glass-ceramic cooktop that includes a glass panel on which pots, pans, or the like may be heated by a number of radiant heating elements positioned below the glass panel.

SUMMARY

According to one aspect, a cooking appliance includes a glass cooktop panel and a cooktop frame. A radiant heating element is positioned between the cooktop frame and the glass cooktop panel. The heating element has an upper surface biased toward a lower surface of the glass cooktop panel. A screwless spring clip is coupled to both the heating element and the cooktop frame so as to secure the heating element to the cooktop frame.

In some embodiments, the spring clip may include a locking tab positioned in a slot formed in a lower surface of the heating element.

The spring clip may also include a biasing tab biased against an upwardly extending sidewall of the heating element.

The spring clip may further include a locking flange positioned in a slot formed in the cooktop frame.

In an illustrative embodiment, the spring clip urges the heating element upwardly so as bias the upper surface of the heating element into contact with the lower surface of the glass cooktop panel.

The spring clip may also include a support flange positioned under a lower surface of the heating element so as to support the heating element.

According to another aspect, a screwless spring clip for securing a radiant heating element between a glass cooktop surface and a cooktop frame of a cooking appliance includes a support flange configured to contact a lower surface of the heating element so as to support the heating element when the spring clip is secured to the heating element. The spring clip also includes a locking tab extending upwardly form the support flange and configured to be received into a slot formed in the lower surface of the heating element when the spring clip is secured to the heating element. A locking flange of the spring clip is configured to be received into a slot formed in the cooktop frame when the spring clip is secured to the cooktop frame.

The spring clip may further include a biasing tab that is biased against an upwardly extending sidewall of the heating element when the spring clip is secured to the heating element.

In an embodiment, the spring clip further includes a biasing flange that is configured to exert an upward bias so as to urge the support flange upwardly against the lower surface of the heating element when the spring clip is secured to both the heating element and the cooktop frame.

According to yet another aspect, a method of assembling a cooking appliance includes squeezing a spring clip so as to move a biasing tab of the spring clip from an engaged position to a disengaged position. The method also includes inserting a locking tab of the spring clip into a slot formed in a lower surface of a heating element while the biasing tab of the spring clip is positioned in the disengaged position. The method further includes releasing the spring clip such that the biasing tab of the spring clip is moved from the disengaged position to the engaged position and into contact with a sidewall of the heating element so as to secure the spring clip to the heating element.

The method may also include inserting a locking flange of the spring clip into a slot formed in a cooktop frame, with the spring clip secured to the heating element, so as to secure the heating element to the cooktop frame.

A glass cooktop panel may then be advanced downwardly onto the heating element. In doing so, a lower surface of the glass cooktop panel may be urged into contact with an upper surface of heating element.

The spring clip may be compressed during such downward advancement of the glass cooktop panel.

An upward bias may be exerted on the heating element by the spring clip so as to urge upper surface of the heating element into contact with the lower surface of the glass cooktop during such downward advancement of the glass cooktop panel.

BRIEF DESCRIPTION OF THE DRAWING

The detailed description particularly refers to the following figures, in which.

DETAILED DESCRIPTION OF THE DRAWING

Figure 1:
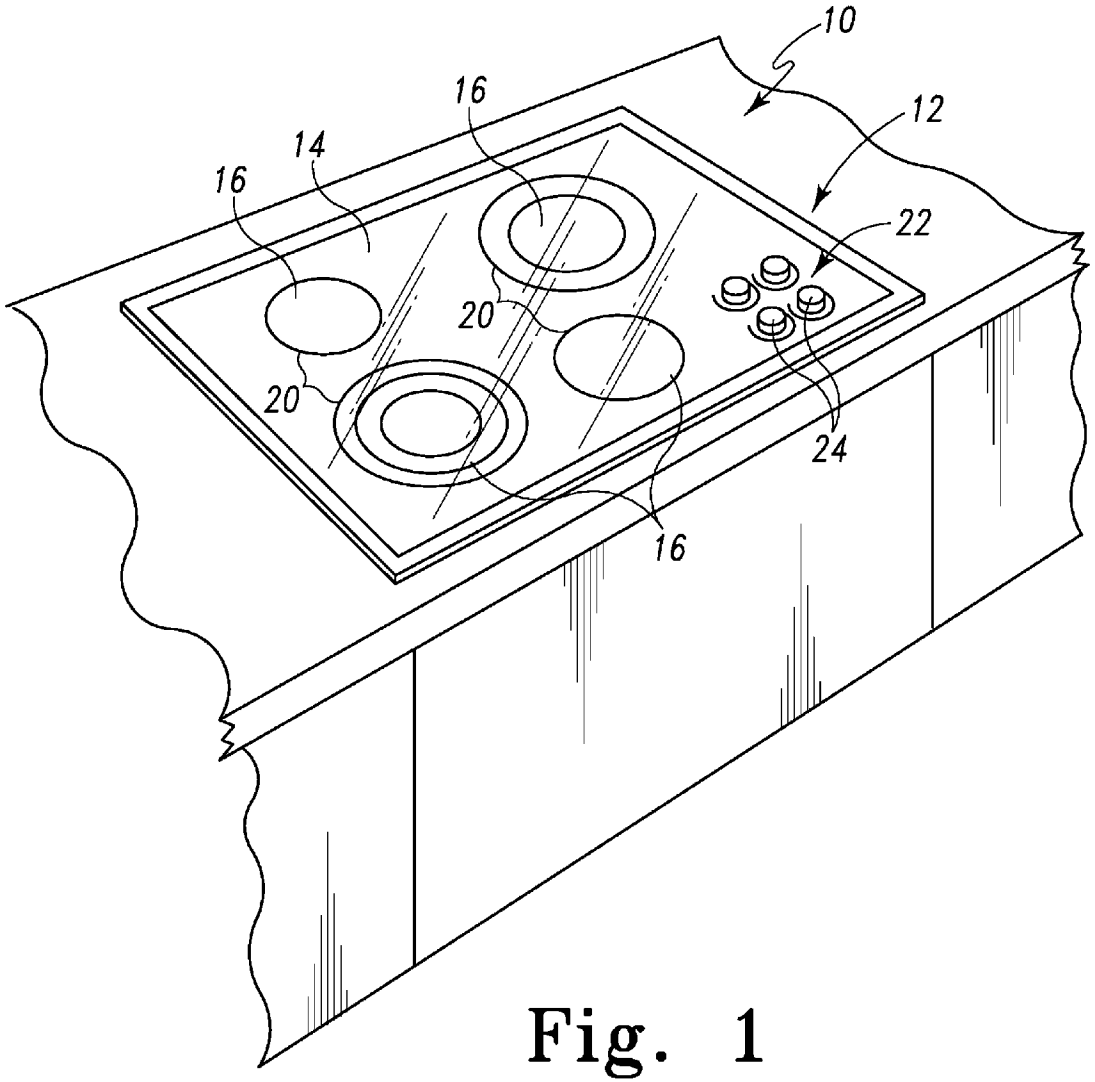
FIG. 1 is a perspective view of a cooking appliance.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring to FIG. 1, a cooking appliance 10 is shown. The cooking appliance 10 is embodied as a glass-ceramic cooktop 12. Although the cooktop 12 is illustrated in FIG. 1 as a built-in cooktop (i.e., a cooktop built into the countertop of the kitchen), the cooktop 12 may alternatively be embodied as a component of a freestanding range. The cooktop 12 has a glass cooktop panel 14 that defines a plurality of separately controlled cooking areas 16. In the illustrative embodiment of FIG. 1, the glass cooktop panel 14 has four cooking areas 16. A radiant heating element 18 (see FIG. 4) is positioned below each cooking area 16. Each heating element 18 is operable to heat its corresponding cooking area 16 of the glass cooktop panel 14 to a desired cooking temperature. An outer perimeter 20 designates to the user where the user should place pots, pans, and the like to be heated by each of the heating elements 18.

The glass-ceramic cooktop 12 also includes a control panel 22 having a number of control knobs 24. A user may separately control the temperature of each of the heating elements 18 using a corresponding one of the knobs 24 of the control panel 22.

Figure 3:
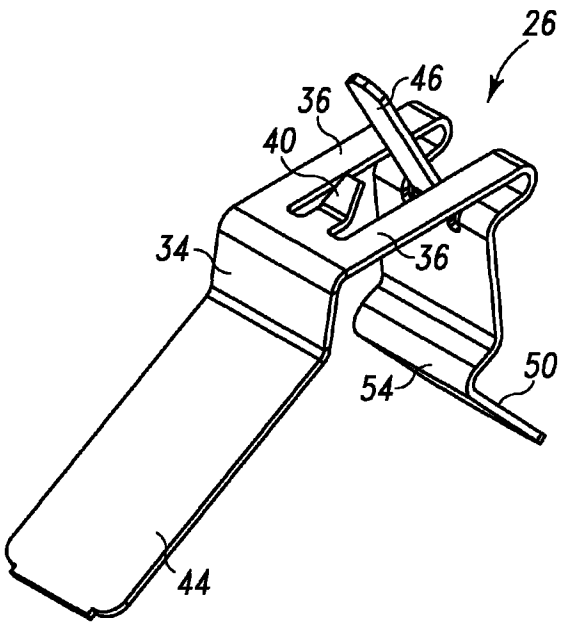
FIG. 3 is a perspective view of the spring clip of FIG. 2.
Figure 2:
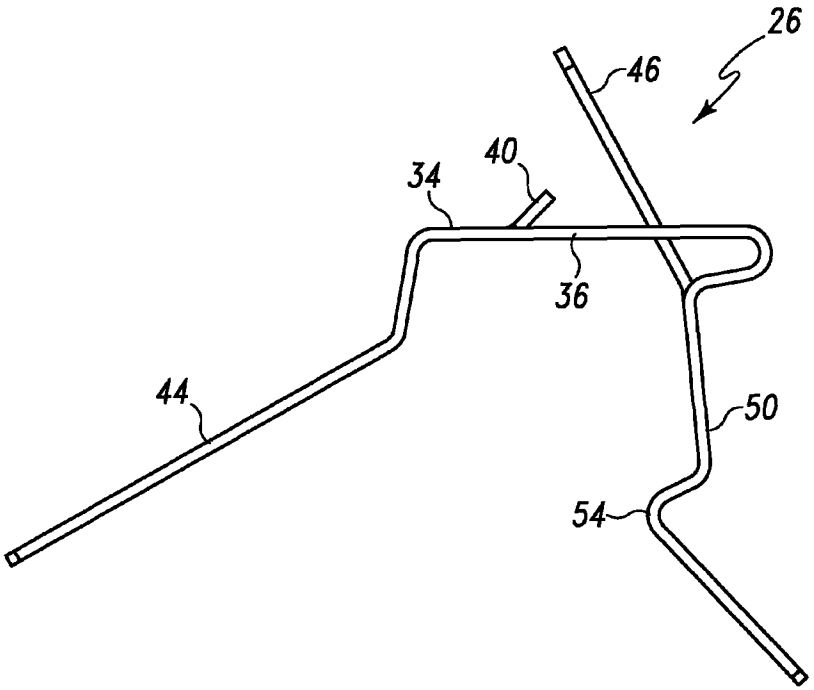
FIG. 2 is a side view of a screwless spring clip for securing the heating elements to the cooking appliance of FIG. 1.
Figure 4:
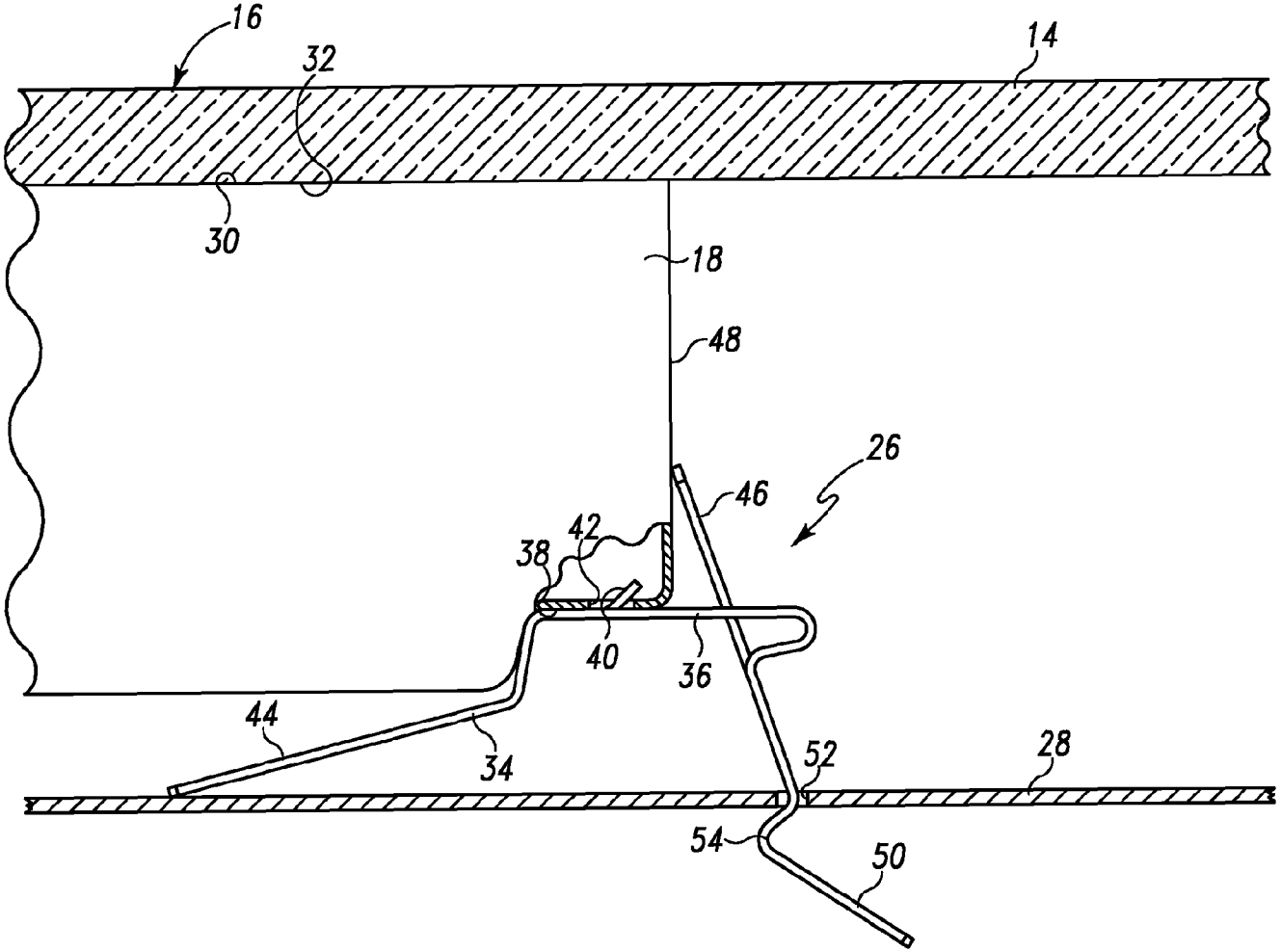
FIG. 4 is a cross sectional view showing the spring clip installed in the cooking appliance of FIG. 1, note most of the heating element is not shown in cross section for clarity of description.

Referring now to FIGS. 2-4, there is shown a screwless spring clip 26 that is used to secure the heating elements 18 to a cooktop frame 28 underlying the glass cooktop panel 14. What is meant herein by the term "screwless" in regard to the spring clip is that the spring clip is configured to perform the function of securing the heating element to the cooktop frame without the use of screws, bolts, rivets, or other types of separate fasteners. In other words, the structure of the spring clip itself provides the mechanical features necessary to secure the heating element to the cooktop frame.

The spring clip 26 is made of, for example, spring steel and is configured to both secure the heating elements 18 to the cooktop frame 28, and also create a spring bias to urge the upper surfaces 30 of the heating elements 18 into contact with the lower surface 32 of the glass cooktop panel 14. As noted above, the illustrative embodiment of the glass-ceramic cooktop 12 described herein includes four heating elements 18. A portion of one of the four heating elements 18 is shown in FIG. 4. Each of the heating elements 18 is secured to the cooktop frame 28 by two or more of the spring clips 26.

The body 34 of the spring clip 26 has a pair of horizontal support flanges 36 formed therein. As can be seen in FIG. 4, the support flanges 36 contact, and hence support, the lower surface 38 of the heating element 18. A locking tab 40 extends upwardly from the support flanges 36 and is received into a slot 42 positioned in the lower surface 38 of the heating element 18. As will be described below, insertion of the locking tab 40 into the slot 42 locks the spring clip 26 to the heating element 18.

The body 34 of the spring clip 26 also has a biasing flange 44 that extends downwardly at an angle away from the horizontal support flanges 36. As will be discussed below in greater detail, when the glass-ceramic cooktop 12 is assembled, the spring clip 26 is compressed. When the spring clip 26 is compressed, the biasing flange 44 exerts an upward bias that is applied to the heating element 18 through the support flanges 36 thereby urging the heating element's upper surface 30 into contact with the lower surface 32 of the glass cooktop panel 14.

A biasing tab 46 extends upwardly from the horizontal support flanges 36. The biasing tab 46 exerts an inward bias on the upwardly extending vertical sidewall 48 of the heating element 18. Specifically, the biasing tab 46 exerts a bias on the heating element which urges the heating element 18 in the direction toward the locking tab 40 thereby locking the locking tab 40 within the slot 42 formed in the generally horizontal lower surface 38 of the heating element 18. In the context of the orientation of FIG. 4, the biasing tab 46 asserts a bias on the sidewall 48 of the heating element 18 that urges the heating element to the left so that the locking tab 40 extends beyond the right edge slot 42 thereby locking the spring clip 26 to the heating element 18.

The body 34 of the spring clip 26 also has a locking flange 50 that extends downwardly at an angle away from the horizontal support flanges 36 that is steeper than the angle at which the biasing flange 44 extends away from the support flanges 36. The locking flange 50 extends through a slot 52 formed in the cooktop frame 28 so as to secure the spring clip 26 (and hence the heating element 18) to the cooktop frame 28. The locking flange 50 has a curl 54 formed therein. The curl 54 retains the locking flange 50 in the slot 52—i.e., it prevents the clip 26 from lifting out of slot 52 without being manipulated by a user to do so.

Figure 5:
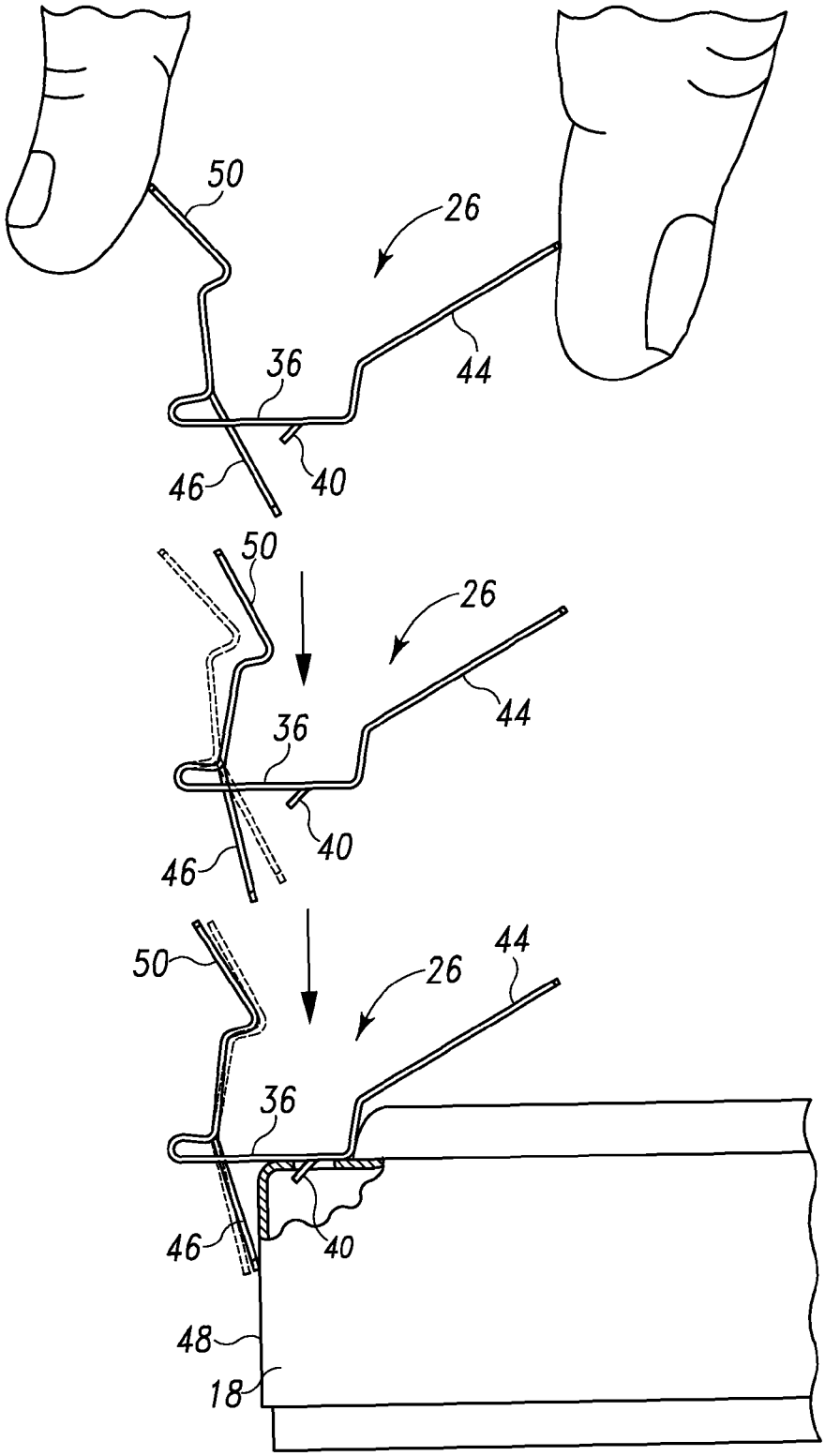
FIG. 5 is a side view showing the spring clip in various positions during installation of the spring clip to the heating element.

Assembly of the glass-ceramic cooktop 12 will now be discussed in regard to FIGS. 4 and 5. The spring clip 26 is first installed on the heating element 18 and then the heating element 18 is secured to the cooktop frame 28. Installation of the spring clip 26 to the heating element 18 is shown in three steps in FIG. 5. As shown in the top position of FIG. 5, the spring clip 26 is in an initial position, which is an uncompressed state. A user first grabs the biasing flange 44 and the locking flange 50 of the spring clip 26 between the user's fingers. The user then squeezes the spring clip 26 into a compressed first position to urge the biasing flange 44 and the locking flange 50 toward one another. The initial position of the spring clip 26 (i.e., its relaxed or "unsqueezed" orientation) is shown in phantom in the middle position of FIG. 5, with the squeezed orientation of the spring clip 26 in the first position shown in solid lines. Squeezing the spring clip 26 in such a manner urges the biasing tab 46 from its engaged position (i.e., the position in which it rests when engaged with the sidewall 48 of the heating element 18 as show in phantom lines in the middle position of FIG. 5) to a disengaged position (i.e., the position in which it is spaced apart to provide clearance from the sidewall 48 of the heating element 18 as show in solid lines in the middle position of FIG. 5).

With the spring clip 26 squeezed into the first position, the user moves the clip 26 toward the heating element 18 and inserts the clip's locking tab 40 into the slot 42 formed in the lower surface 38 of the heating element 18 (see FIG. 4). The lower surface 38 is generally perpendicular to the sidewall 48. With the locking tab 40 now positioned in slot 42, the user releases spring clip 26 to an uncompressed second position thereby allowing the biasing flange 44 and the locking flange 50 to relax and hence move away from one another. Doing so moves the biasing tab 46 from its disengaged position to its engaged position in which it exerts an inward bias on the sidewall 48 of the heating element 18. Such a bias urges the heating element 18 in the direction toward the locking tab 40 thereby locking the locking tab 40 within the slot 42 formed in the lower surface 38 of the heating element 18. In the context of the orientation of FIG. 4, the biasing tab 46 asserts a bias on the sidewall 48 of the heating element 18 that urges the heating element to the left so that the locking tab 40 extends beyond the right edge slot 42 thereby locking the spring clip 26 to the heating element 18, whereas in the context of the orientation of FIG. 5, the heating element 18 is urged to the right by the biasing tab 46.

One or more additional spring clips 26 (not shown) are then installed to the heating element 18 in the same manner. Once the spring clips 26 are installed, the heating element 18 is secured to the cooktop frame 28. To do so, the locking flange 50 of each of the spring clips is inserted into one of the corresponding slots 52 formed in the cooktop frame 28. It should be appreciated that one of the spring clips 26 may first be installed and then the heating element 18 nudged toward the installed element to provide clearance for installation of the other spring clip 26 into its slot 52 on the opposite side.

Once installed, the curls 54 defined in the locking flanges 50 prevent the clips 26 from inadvertently lifting out of slots 52.

Once installed to the cooktop frame 28, the heating elements 18 "float" somewhat. In particular, the bias of the spring clips 26 urges the heating elements 18 upwardly, but the heating element 18 can be urged downwardly by a downward force sufficient to overcome the bias of the spring clips 26. Prior to installation of the glass cooktop panel 14, the spring clips 26 position the heating elements 18 in a slightly higher position than their final post-assembly position.

To complete the assembly process, the glass cooktop panel 14 is installed. To do so, the glass cooktop panel 14 is aligned with the heating elements and moved downwardly such its lower surface 32 is advanced into contact with the upper surface 30 of each of the heating elements 18. The glass cooktop panel 14 is then urged downwardly a predetermined distance further against the bias of the spring clips 26. This causes the spring clips 26 to generate an upward bias which loads the upper surface 30 of the heating elements 18 into firm contact with the lower surface 32 of the glass cooktop panel 14. The edges of the glass cooktop panel 14 are then fastened to the cooktop frame 28 by the use of screws, bolts, or other fasteners.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the method, apparatus, and system described herein. It will be noted that alternative embodiments of the method, apparatus, and system of the present disclosure may not include all of the features described yet still benefit from at least some of the advantages of such features. Those of ordinary skill in the art may readily devise their own implementations of the method, apparatus, and system that incorporate one or more of the features of the present invention and fall within the spirit and scope of the present disclosure as defined by the appended claims.

The invention claimed is:

1. A cooking appliance comprising:

a cooktop panel;

a cooktop frame configured to support the cooktop panel;

a radiant heating element disposed between the cooktop frame and the cooktop panel, wherein a sidewall and a lower surface of the radiant heating element are substantially perpendicular, and a screwless spring clip comprising a first position, a second position and a third position;

wherein the first position is an initial position, the second position is configured to engage the heating element, and the third position is between the first position and the second position and configured to retain mechanical engagement to the heating element sidewall and lower surface.

2. The cooking appliance of claim 1, wherein the spring clip further comprises a locking tab positioned in a slot formed in the lower surface of the heating element.

3. The cooking appliance of claim 2, wherein the spring clip further comprises a biasing tab configured to push against the sidewall of the heating element.

4. The cooking appliance of claim 1, wherein the spring clip comprises a locking flange positioned in a slot formed in the cooktop frame.

5. The cooking appliance of claim 1, wherein the spring clip urges the heating element upwardly so as bias the upper surface of the heating element into contact with the lower surface of the cooktop panel.

6. The cooking appliance of claim 1, wherein the spring clip comprises:

a support flange positioned under a lower surface of the heating element so as to support the heating element, and a locking tab extending upwardly form the support flange and positioned in a slot formed in the lower surface of the heating element.

7. The cooking appliance of claim 1, wherein the second position is a squeezed position.

8. The cooking appliance of claim 7, wherein the squeezed position is a compressed state.

9. The cooking appliance of claim 1, wherein the first position is an unsqueezed position.

10. The cooking appliance of claim 9, wherein the unsqueezed position is an uncompressed state.

11. A radiant heating element spring clip comprising:

a support flange configured to contact a lower surface of the heating element, a locking tab extending upwardly from the support flange and configured to be received into a slot formed in the lower surface of the heating element, and a locking flange configured to be received into a slot formed in a frame, wherein the spring clip has an initial uncompressed state, is configured to engage the heating element in a first position and screwlessly retain mechanical engagement to the heating element in a second position.

12. The cooking appliance of claim 11, wherein the spring clip comprises a biasing tab biased against an upwardly extending sidewall of the heating element when the spring clip is secured to the heating element.

13. The cooking appliance of claim 11, wherein the spring clip further comprises a biasing flange configured to exert an upward bias so as to urge the support flange upwardly against the lower surface of the heating element.

14. The cooking appliance of claim 11, wherein the first position is a squeezed position.

15. The cooking appliance of claim 14, wherein the squeezed position is a compressed state.

16. The cooking appliance of claim 11, wherein the second position is an unsqueezed position.

17. The cooking appliance of claim 16, wherein the unsqueezed position is an uncompressed state.

18. A cooking appliance, comprising:

a cooktop;

a frame configured to support the cooktop;

a radiant heating element disposed between the frame and the cooktop; and a spring clip configured to couple the heating element to the frame and configured to couple the heating element to the cooktop, the spring clip comprising:

a support flange configured to contact a surface of the heating element, a locking tab extending from the support flange toward the heating element, and a biasing tab configured to engage a surface of the heating element substantially perpendicular to the support flange, wherein the spring clip has an initial uncompressed position, is configured to engage the heating element when in a first position, and screwlessly retain mechanical engagement to the heating element between the locking tab and the biasing tab when released to a second position.

19. The cooking appliance of claim 18, further comprising a locking flange configured to be received in an aperture formed in the frame.

20. The cooking appliance of claim 18, further comprising a biasing flange configured to bias the heating element toward the cooktop when in an installed position.

* * * * *